United States Patent [19]

Schuster et al.

[11] Patent Number: 4,489,546

[45] Date of Patent: Dec. 25, 1984

[54] FRICTION FALSE-TWISTING UNIT

[75] Inventors: Friedrich Schuster, Hammelburg; Hans Weigert, Schweinfurt, both of Fed. Rep. of Germany

[73] Assignee: FAG Kugelfischer Georg Schafer & Co., Fed. Rep. of Germany

[21] Appl. No.: 495,813

[22] Filed: May 18, 1983

[30] Foreign Application Priority Data

May 19, 1982 [DE] Fed. Rep. of Germany ..... 3218902

[51] Int. Cl.[3] ..... D02G 1/04; D01H 7/92

[52] U.S. Cl. ..... 57/340; 57/337; 57/338; 57/339

[58] Field of Search ..... 57/337, 338, 339, 340, 57/348

[56] References Cited

U.S. PATENT DOCUMENTS

| | | | |
|---|---|---|---|
| 3,074,225 | 1/1963 | Scragg | 57/348 |
| 3,640,144 | 2/1972 | Eckholt | 57/348 X |
| 3,845,613 | 11/1974 | Knebel | 57/340 |
| 4,047,374 | 9/1977 | Venot | 57/338 X |
| 4,060,967 | 12/1977 | Lorenz | 57/339 X |
| 4,110,962 | 9/1978 | Schuster | 57/348 X |
| 4,195,470 | 4/1980 | Sturhahn | 57/338 X |

*Primary Examiner*—Donald Watkins

*Attorney, Agent, or Firm*—Ostrolenk, Faber, Gerb & Soffen

[57] ABSTRACT

A friction false-twisting unit has three upstanding parallel shafts supported on a base plate. Each shaft carries a plurality of friction disks and the disks are overlapping and interleaved for applying a false twist to filament yarn drawn through the array of disks where they overlap. To damp the oscillation of the entire false twisting unit, it is fastened to the machine bed through interposed damping elements. There is a holding mandrel on the base plate which passes through a guide sleeve. The guide sleeve is, in turn, attached to the mount via the damping elements. With the false-twisting unit absent, the damping elements tilt the guide sleeve and when the unit is in place, its weight in use returns the guide sleeve to a correct orientation, so that the plane of the side of the drive whorl on one of the shafts is parallel to the plane of the tangential drive belt for that shaft where that belt passes the drive whorl.

13 Claims, 3 Drawing Figures

Fig. 2
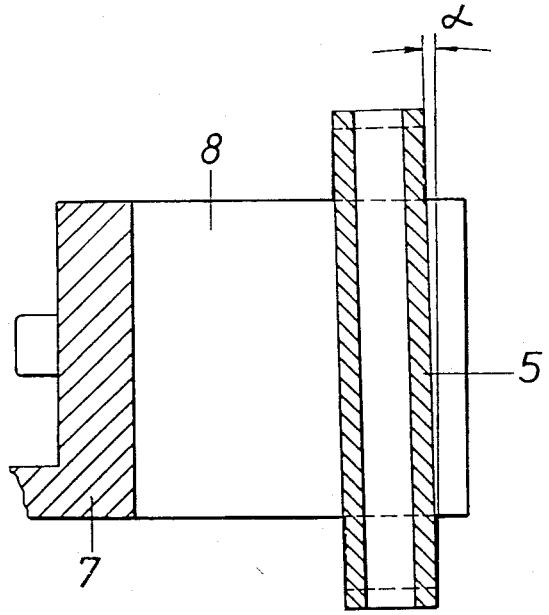
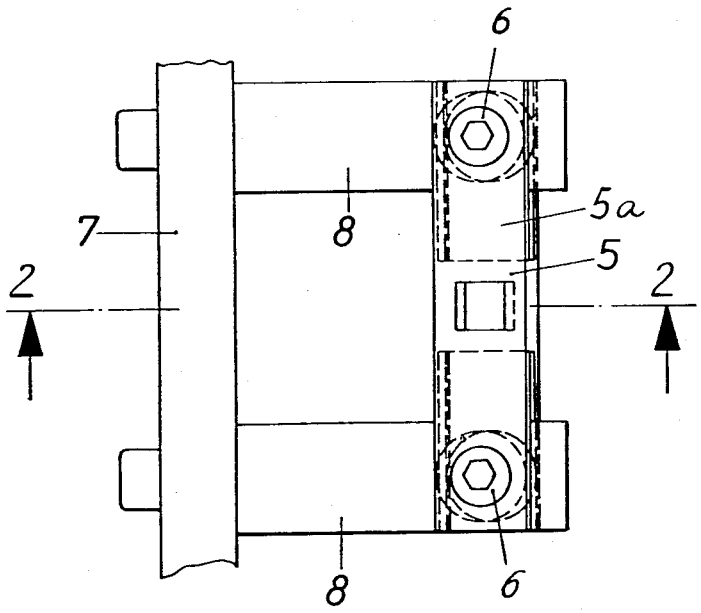
Fig. 3

FRICTION FALSE-TWISTING UNIT

BACKGROUND OF THE INVENTION

The present invention relates to a friction false-twisting unit which is used for friction texturing endless filaments, particularly manufactured filament material used as yarn. Yarn is drawn past a plurality of partially interleaved, overlapping, rotating friction discs, and the friction of the yarn against the discs imparts a false twist to the yarn as it is drawn past the discs. The discs are supported on a plurality of shafts arranged so that the discs overlap at one edge portion or area. For example, three such shafts are provided, preferably arranged in an equilateral triangular array. The invention is particularly concerned with damping the oscillations of the false-twisting unit and with maintaining the desired orientation of the unit whose oscillations are being damped.

A friction false-twisting unit is known from German Patent application DE-OS No. 29 36 845 in which bearings for the shafts, arranged in the support plate, are mounted with little radial oscillation by interposed rubber rings. In this way, absolutely quiet operation is assured, even upon high speeds of shaft rotation.

However, there are disadvantages. While the disturbances, which come, for instance, from the filaments or threads to be false-twisted or from the tangential drive belt for the shafts, are damped, nevertheless the relative axial positions of and the parallel relationship between the three shafts change for a short time, and this leads to yarn defects. Furthermore, close tolerances cannot be obtained between three shafts which are damped by rubber rings. Further still, the force of application of the tangential drive belt presses the individually driven, damped mount away to one side. This changes the geometry of the unit and thus also the quality of the yarn.

SUMMARY OF THE INVENTION

The object of the invention is to eliminate the above drawbacks and to improve a friction false-twisting unit so that damping of oscillation of the entire unit and the installation is effected simply without yarn quality being impaired.

This problem is solved in accordance with the invention. The friction false-twisting unit is fastened to the supporting machine bed through damping elements interposed between the unit and the machine bed. These damping elements are elastomeric, and may be comprised of rubber or plastic. They are preferably electrically conductive to conduct away electrostatic charge generated by the discs spinning in contact with the filaments.

The friction false-twisting unit including its shafts are supported on a base plate. The damping elements are interposed between the machine bed and the base plate. For this purpose, there is a holding mandrel on the base plate. There is a guide sleeve into which the mandrel is inserted. There is a mount fastened to the machine bed. The guide sleeve rests in the mount via the damping elements.

Typically, the shafts of the false-twisting unit are all located to one side of the holding mandrel. The shafts and the base plate apply weight on the holding mandrel and they tend to urge the mandrel which, in turn, urges the guide sleeve, to pivot or twist. The damping elements resist such pivoting or twisting motion and maintain the orientation of the base plate and the shafts thereon. With the base plate and its shafts removed from the holding mandrel, the guide sleeve is normally inclined at an angle from its orientation when the base plate is in place, and the damping elements assure that the guide sleeve has this inclined orientation. One of the shafts is driven by a tangential belt which runs along a drive whorl on that shaft. The tangential belt has a substantial width dimension and at the line of contact between the drive whorl and the belt, the tangential belt should be in the plane of the drive whorl. The damping elements assure that with the base plate and shafts in place and operating, the side of the drive whorl in contact with the tangential belt is in the plane of the tangential belt where it contacts the drive whorl.

Interposing damping elements between the false-twisting unit and the machine bed solves the problem. It has the further advantage that the unit can be placed with initial tension against the tangential drive belt without additional tensioning means being required for this.

The use of damping elements of elastomeric material affords the further possibility of obtaining different damping properties by simple means in the different directions of force since such elastomeric materials respond differently to sheer and/or compressive and/or tensile oscillations.

The invention is explained below in further detail with reference to an illustrative embodiment.

BRIEF DESCRIPTION OF THE DRAWINGS

FIG. 2 is a section through the mount, without the friction false twisting unit; and FIG. 3 is a top view of the mount, without the friction unit.

DESCRIPTION OF A PREFERRED EMBODIMENT

Figure 1:
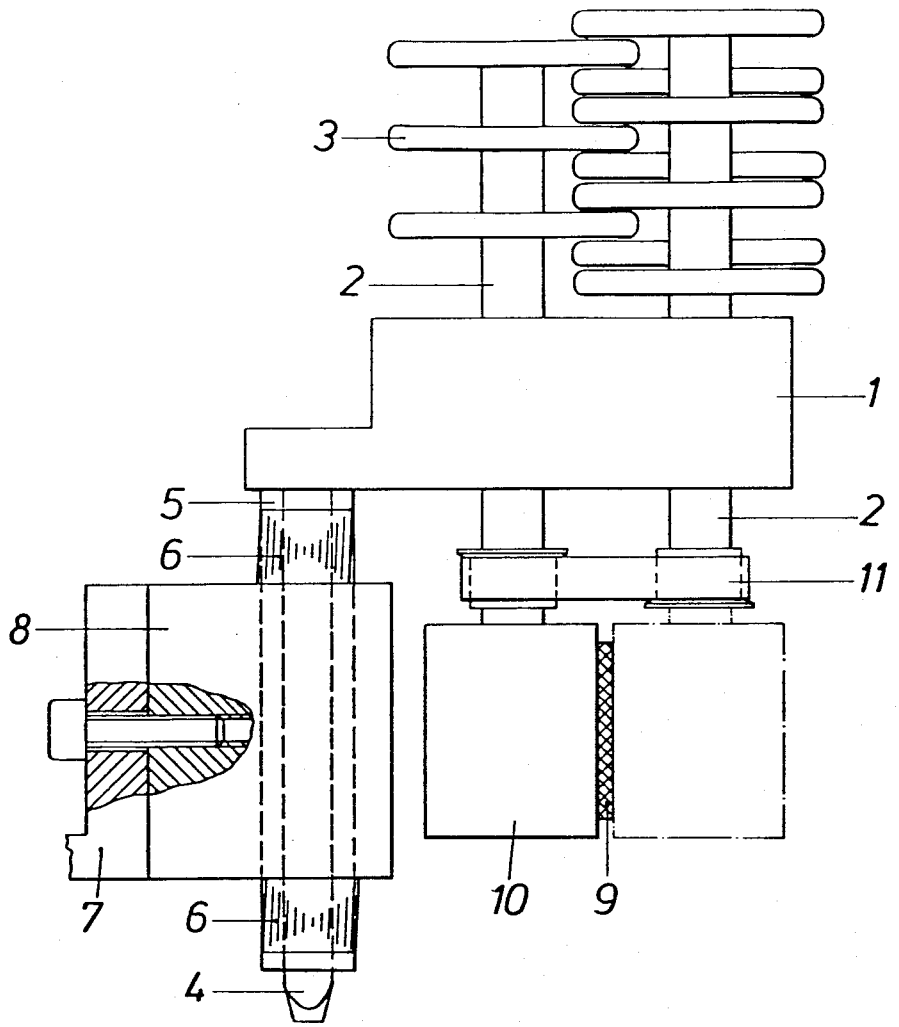
FIG. 1 is a side elevational view of a friction false-twisting unit according to the invention.

Referring to FIG. 1, the friciton false twisting unit has a base plate 1. Three vertically uptanding shafts 2 are rotatably mounted in the base plate. (The third shaft is hidden behind the shaft at the right, as can be seen by the discs 3 on all of the shafts.) The shafts 2 are arranged in an array of an equilateral triangle. The shafts pass through the base plate. Above the base plate 1, each shaft carries a series of spaced apart friction disks 3. The disks are sized so the disks on the adjacent shafts are interleaved or overlapped at the disk edge portions where they meet.

Beneath the base plate and spaced away from the shafts 2, there is a holding mandrel 4 which, for instance, is a square cross-section. The mandrel is inserted into a guide bushing 5, which has a correspondingly shaped bore. The guide bushing 5 rests via a cross arm **5*a* on the damping elements 6 and the damping elements are arranged between the unit and a mount 8 that is connected with the machine bed 7**.

The unit is driven from a tangential belt 9 via the drive whorl 10. The other two shafts 2 are placed in rotation by a toothed belt 11 which surrounds all three shafts. The drive whorl 10 may lie in front of or behind the tangential belt 9 so that the direction of rotation of the disks can be selected, for producing S or Z twist to the yarn.

As can be noted from FIG. 2, when the false twisting unit is not in place, the guide bushing 5 is arranged inclined by the angle $\alpha$ to the spindle rail 7 of the machine bed and to the plane of the tangential belt 9, which extends parallel to the rail. The angle $\alpha$ corresponds to the elastic deformation of the damping elements 6 which is to be expected when the bushing 5 is loaded by the weight of the unit. After the false-twisting unit has been put in place, the axis of the drive whorl is again parallel to the plane of the tangential belt. In this way, the oblique orientation of the unit, which occurs due to the eccentrically acting force of the weight of the unit and to the elastic elements is again compensated for. The angle $\alpha$ is preferably about or slightly greater than 20', i.e. a fraction of 1°.

FIG. 3 shows how the oblique orientation of the guide bushing is obtained. The cross arms which are fastened above and below the mount 8 respectively are shifted somewhat with respect to each other, whereby the damping elements 6 are also held fast. In this way, it is possible to bring the drive whorl 10 against the tangential belt 9 with a certain initial tension, so that no special tensioning devices are needed for pressing the tangential belt against the drive whorl.

The damping elements 6 may, for instance, be known rubber-metal bushings or intermediate plates made of plastic. In order to lead away the electrostatic charge which occurs in operation, the damping elements are made electrically conductive.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A friction false-twisting unit for yarn filament, comprising:

a base plate; a plurality of upstanding shafts supported on and standing up from the base plate; the shafts being oriented parallel to each other; the shafts being rotatable; at least one friction disc carried on each shaft and being rotatable therewith; the shafts being so spaced and the discs being so sized that the discs on all shafts are overlapping at a side thereof, whereby yarn threaded past the overlapping discs contacts all of the overlapping discs;

a machine bed to which the false-twisting unit is fastened; and damping elements interposed between the machine bed and the false twisting unit, wherein the entire false-twisting unit is fastened to the machine bed by the damping elements.

2. The unit of claim 1, wherein the damping elements are interposed between the base plate and the machine bed.

3. The unit of claim 2, wherein the damping elements are disposed to one side of the plurality of shafts.

4. The unit of claim 2, wherein there are at least three of the shafts.

5. The unit of claim 2, wherein the damping elements are made of elastomeric material.

6. The unit of claim 5, wherein the damping elements are made of rubber.

7. The unit of claim 5, wherein the damping elements are made of plastic.

8. The unit of claim 5, wherein the damping elements are electrically conductive for leading away electrostatic charge.

9. The unit of claim 2, further comprising a holding mandrel on the base plate; a guide sleeve into which the mandrel is inserted;

a mount fastened to the machine bed; the guide sleeve resting on the mount, via the damping elements.

10. The unit of claim 9, wherein the holding mandrel is disposed to one side of the plurality of shafts.

11. The unit of claim 9, further comprising a tangential belt for engaging one of the shafts tangentially for driving that shaft to rotate; the tangential belt having a width dimension and the belt being oriented to place the belt with its width dimension in a plane at the one shaft;

the guide sleeve being normally inclined at an angle to the plane of the tangential belt when the false-twisting unit is separated from the guide sleeve.

12. The unit of claim 11, further comprising a drive whorl on one of the shafts; the whorl having a side in driving engagement with the belt; the angle of incline of the guide sleeve being related to the elastic deformation of the damping elements, such that with loading of the false-twisting unit while it is in use through rotation of the shafts thereof, the plane of the tangential belt is parallel to the engaged side of the drive whorl.

13. The unit of claim 12, wherein the angle of inclination of the guide sleeve to the plane of the belt in about 20'.

* * * * *